US008727732B2

(12) United States Patent
Webb et al.

(10) Patent No.: US 8,727,732 B2
(45) Date of Patent: May 20, 2014

(54) FAN BLADE MOUNTING SYSTEM

(75) Inventors: Alan Clark Webb, Olive Branch, MS (US); Daniel Eugene Rowton, Collierville, TN (US)

(73) Assignee: Hunter Fan Company, Memphis, TN (US)

( * ) Notice: Subject to any disclaimer, the term of this patent is extended or adjusted under 35 U.S.C. 154(b) by 1000 days.

(21) Appl. No.: 12/822,666

(22) Filed: Jun. 24, 2010

(65) Prior Publication Data

US 2011/0116946 A1 May 19, 2011

Related U.S. Application Data

(60) Provisional application No. 61/262,174, filed on Nov. 18, 2009.

(51) Int. Cl.
*F04D 29/34* (2006.01)

(52) U.S. Cl.
USPC ..... 416/210 R; 416/214 R

(58) Field of Classification Search
USPC ..... 416/210 R, 207, 208, 204 R, 214 R; 403/221–228, 238–240, 243, 365–371; 411/512, 999
See application file for complete search history.

(56) References Cited

U.S. PATENT DOCUMENTS

| | | | | |
|---|---|---|---|---|
| 404,964 | A | | 6/1889 | Elliott |
| 925,031 | A | | 6/1909 | Russel |
| 2,041,507 | A | | 5/1936 | Zeder |
| 2,041,555 | A | | 5/1936 | Lee |
| 2,119,398 | A | | 5/1938 | Morse |
| 2,270,583 | A | | 1/1942 | Forton |
| 2,299,010 | A | | 10/1942 | Doman |
| 2,678,104 | A | | 5/1954 | Davis |
| 2,678,585 | A | * | 5/1954 | Ellis ..... 351/145 |
| 2,702,087 | A | | 2/1955 | Beier |
| 2,965,180 | A | | 12/1960 | Killam |
| 2,987,242 | A | | 6/1961 | Mazzacane |
| 3,014,563 | A | | 12/1961 | Bratton |
| 3,033,049 | A | | 5/1962 | Morrow |
| 3,861,828 | A | | 1/1975 | Biermann et al. |
| 3,893,555 | A | | 7/1975 | Elmer |
| 3,909,927 | A | | 10/1975 | Steward |
| 4,245,957 | A | * | 1/1981 | Savage et al. ..... 416/135 |
| 4,396,352 | A | | 8/1983 | Pearce |
| 4,437,784 | A | | 3/1984 | Peterson |
| 4,511,310 | A | | 4/1985 | Pearce |
| 4,850,799 | A | | 7/1989 | Bucher, Sr. et al. |
| 4,917,573 | A | | 4/1990 | Sikula, Jr. |

(Continued)

*Primary Examiner* — Edward Look
*Assistant Examiner* — Liam McDowell
(74) *Attorney, Agent, or Firm* — Dorian B. Kennedy; Baker Donelson

(57) ABSTRACT

A ceiling fan (10) is disclosed having a motor housing (11) suspended through a downrod (12). An electric motor (13) is mounted within the housing which drives an annular array of blade irons (14) each having a blade (15) mounted thereto. Each blade has three clearance or mounting hole (16) and a resilient annular grommet (17) is positioned within each mounting hole. Each blade iron (14) has a blade mounting portion (23) with a peripheral seat (23)' and three blade fasteners (24). Each blade fastener is configured to pass through the fastener mounting hole and grommet. Each fastener has a neck (25) with an annular groove (26), and a head (27) having a diameter larger than that of the neck. The head is positioned directly adjacent the groove so that contact between the head and the grommet forces a portion of the grommet into the annular groove.

9 Claims, 3 Drawing Sheets

(56) References Cited

U.S. PATENT DOCUMENTS

| | | | | |
|---|---|---|---|---|
| 4,998,332 | A | 3/1991 | Dacey, Jr. | |
| 5,304,037 | A | 4/1994 | Scofield | |
| 5,308,285 | A * | 5/1994 | Malen et al. | 470/4 |
| 5,314,280 | A | 5/1994 | Gagliardi et al. | |
| 5,464,323 | A | 11/1995 | Scofield | |
| 5,944,487 | A | 8/1999 | Pearce | |
| 6,039,540 | A * | 3/2000 | Wu | 416/210 R |
| 6,171,059 | B1 * | 1/2001 | Bucher et al. | 416/210 R |
| 6,382,917 | B1 | 5/2002 | Zuege | |
| 6,821,091 | B2 * | 11/2004 | Lee | 416/210 R |
| 6,872,053 | B2 * | 3/2005 | Bucher et al. | 416/210 R |
| 7,527,478 | B2 | 5/2009 | Pearce | |
| 2002/0127106 | A1 * | 9/2002 | Kerr, Jr. | 416/210 R |
| 2003/0099545 | A1 * | 5/2003 | Liang | 416/210 R |
| 2009/0035143 | A1 * | 2/2009 | Wang | 416/210 R |

* cited by examiner

FAN BLADE MOUNTING SYSTEM

REFERENCE TO RELATED APPLICATION

Applicant claims the benefit of U.S. Provisional Patent Application Ser. No. 61/262,174 filed Nov. 18, 2009.

TECHNICAL FIELD

This invention relates to ceiling fan blades and blade irons, and specifically to systems for quickly connecting blades to blade irons.

BACKGROUND OF THE INVENTION

Electrically powered ceiling fans typically have a motor mounted within a stationary housing that is suspended from a ceiling. In operation, the motor rotates an annular array of individual extensions in the form of blade irons. Each blade iron is associated with a blade mounted thereto.

Ceiling fans are usually sold at retail with their blades packed separately from the blade irons for compactness. In mounting a ceiling fan, the housing is normally mounted in suspension from the ceiling through a downrod and then the blades are mounted to the blade irons and the blade irons are mounted to the motor.

The blades of ceiling fans are usually coupled to the blade irons by passing mounting screws through holes in the blade and into threaded holes in the blade iron. This task however can be difficult or tedious when the electric motor is already suspended from the ceiling. The difficulty is attributed to the fact that the mounting screws are usually passed from the top of the blade to hide the screw heads from view. The installer must align the holes in the blade with the holes in the blade iron while simultaneously passing the screws through the holes. The installer typically does this from a position below the ceiling fan, thereby limiting the installer's ability to view the mounting holes and thus aligning the mounting holes and drivably rotate the screws.

Accordingly, it is seen that a need remains for a blade that can be quickly and easily mounted to a blade iron. It is to the provision of such therefore that the present invention is primarily directed.

SUMMARY OF THE INVENTION

A fan blade mounting system comprises a blade iron and a ceiling fan blade associated with said blade iron. The blade has a plurality of mounting holes and a resilient, annular grommet positioned within each mounting hole. The grommet has a central passage therethrough. The blade iron has a blade mounting portion with a plurality of fasteners arranged in a pattern to mate with the plurality of blade mounting holes and the grommets. Each fastener has a neck having a neck diameter configured to be received within the grommet central passage and a head having a head diameter greater than the neck diameter. The neck also has an annular groove extending into the neck adjacent the head. With this construction, the contact of the head against the grommet forces a portion of the grommet into the neck annular groove.

DETAILED DESCRIPTION

Figure 1:
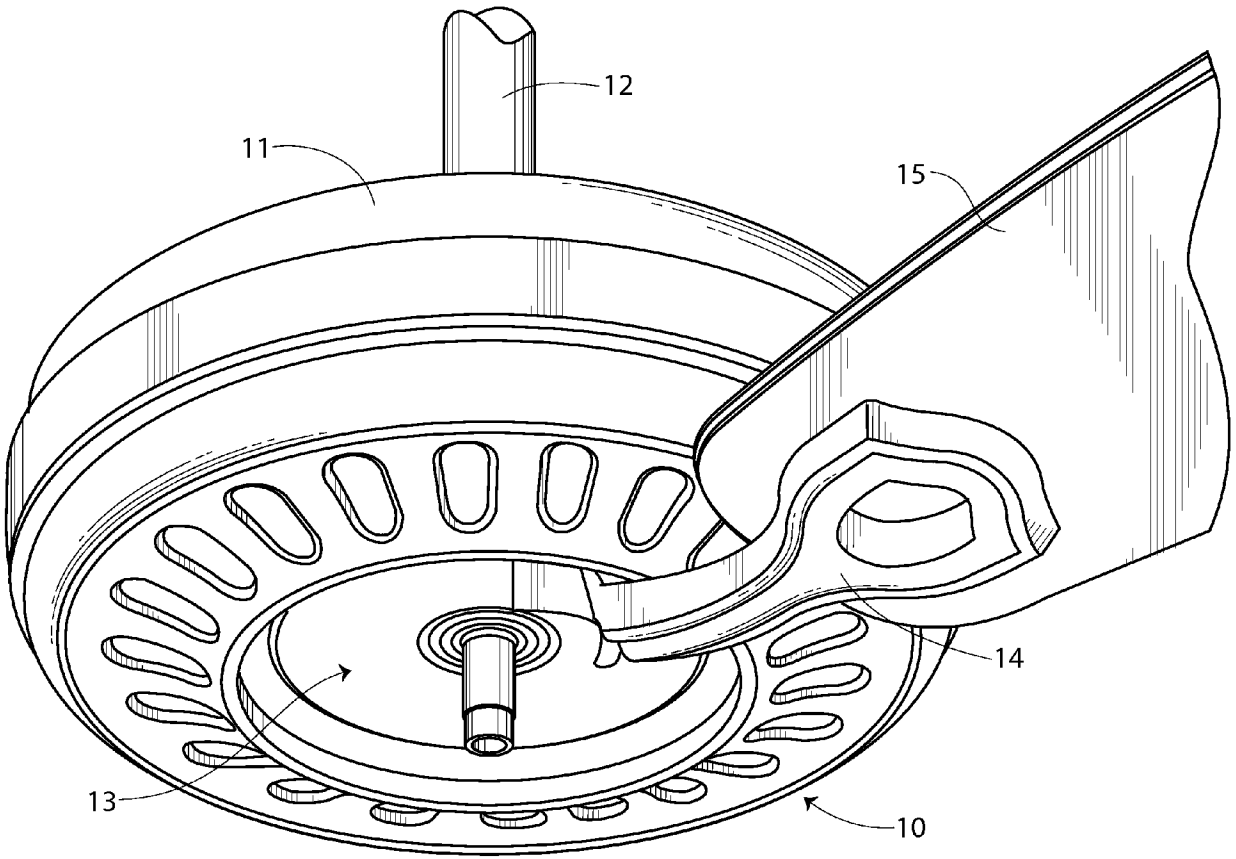
FIG. 1 is a perspective view of the ceiling fan motor, motor housing, blade and blade iron embodying principles of the invention in a preferred form.
Figure 2:
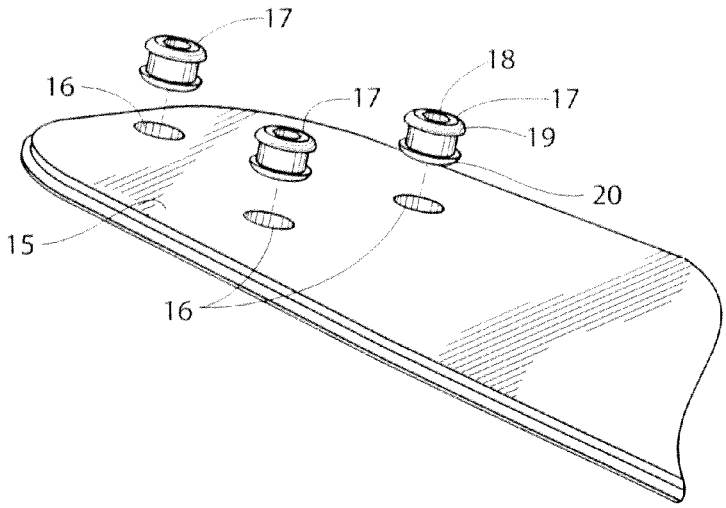
FIG. 2 is a perspective view of a blade of the fan of FIG. 1.

With reference next to the drawings, there is shown a ceiling fan 10 having a motor housing 11 suspended from an unshown ceiling through a downrod 12. An electric motor 13 is mounted within the housing 11 and connected to a source of electric power by wires that extend through the downrod 12. The motor rotatably drives an annular array of blade irons 14, only one being shown for clarity, each having a blade 15 mounted thereto.

Each blade has three clearance or mounting hole 16 extending therethrough. A resilient annular grommet 17 is positioned within each mounting hole 16. Each grommet 17 has a central passage or channel 18, a top lip or flange 19, and a bottom lip or flange 20.

Each blade iron 14 has a motor mounting flange 21 configured to be coupled with the electric motor 13 for rotation, a neck 22, and a blade mounting portion 23. The blade mounting portion 23 has a peripheral top surface, edge or seat 23' facing the ceiling and three blade fasteners or retainers 24. The blade iron also includes an elevated fastener seat 24' associated with each fastener 24. The peripheral seat 23' and fastener seats 24' have top surfaces which are generally coplanar, so that the grommet bottom lip 20 raises the blade slightly above the peripheral seat 23' to avoid the creation of noise associated with the contacting of the blade against the blade iron.

Each blade fastener 24 is configured to pass through the fastener mounting hole 16 and grommet central channel 18. The blade fastener 24 may be formed integrally with the other components of the blade iron or formed separately and subsequently mounted to the blade iron, as by threading them into the blade mounting portion which is shown in the preferred embodiment because of the ability to remove the fastener as discussed hereinafter. The fastener 24 has a neck 25 with an annular groove 26 and a head 27 having a diameter larger than that of the neck. The head is positioned directly adjacent the groove 26 so as to increase the surface area of the underside of the head. However, it should be understood that as an alternative the groove 26 may be spaced from the head. The head 27 may include a tool or screwdriver groove 28 therein extending from the top surface.

Figure 3:
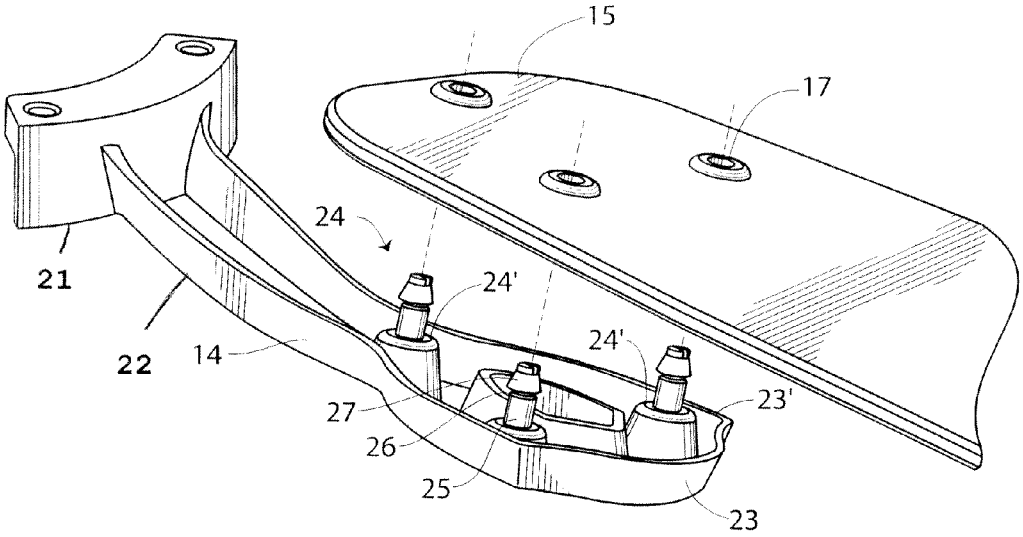
FIG. 3 is a perspective view of the blade iron and blade of FIG. 1, shown in an unmounted configuration.
Figure 4:
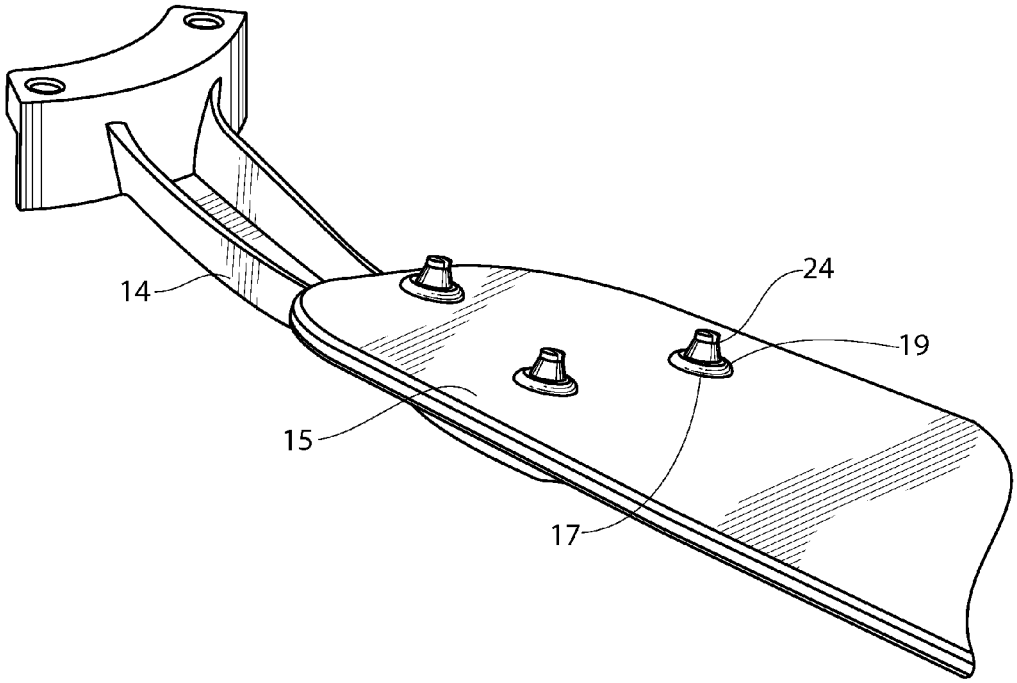
FIG. 4 is a perspective view of the blade iron and blade of FIG. 1, shown in a mounted configuration.
Figure 5:
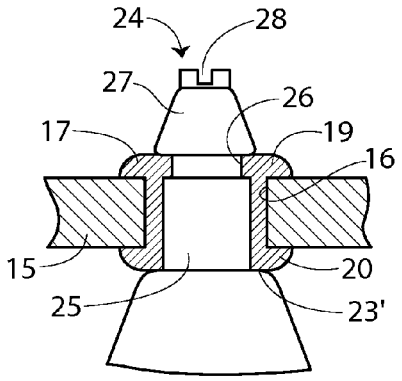
FIG. 5 is a cross-sectional view of a portion of the blade iron and blade of FIG. 1.

In use, the downrod 12 is coupled to the ceiling with the motor housing 11 coupled to the opposite end of the downrod with the blade irons 14 already mounted to the motor 13. With the grommets 17 mounted within the blade mounting holes 16, the blade mounting holes 16 are aligned with the fasteners 24 and lowered so that the fastener 24 passes through the grommets central channel 18, as shown in FIGS. 3-5. With the blade 15 positioned against the top surface or seats 23' of the blade iron, the head 27 of each fastener protrudes from the grommet 17 and presses against the top surface of the grommet resulting in a compression and deformation of the grommet. This compression of the grommet causes a portion of the grommet to be forced into the annular groove 26, i.e. a portion of the grommet bulges into the annular groove as shown in FIG. 5. As such, the grommet prevents the movement of the blade relative to the underlying blade iron by limiting relative movement of the grommet through the pressure applied by the underside of the fastener head and the groove against the top of the grommet. Essentially, the coextensive groove increases the surface area of the underside of the head to increase the holding power of the head against the grommet.

The blade may be removed by applying a large enough upward force to overcome the binding force of the grommets. Alternatively, the blade may be removed by removing the fasteners from the blade iron by inserting a screwdriver into the head groove 29 and unthreading the fastener.

It thus is seen that a quick connect ceiling fan blade is now provided which enables the blade to be mounted and dismounted easily, quickly and in a reliable and secure manner. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. A fan blade mounting system comprising:

a blade iron and a ceiling fan blade associated with said blade iron, said ceiling fan blade having a plurality of mounting holes and a resilient, annular grommet positioned within each of said mounting holes, said grommet having a central passage therethrough, said blade iron having a blade mounting portion with a plurality of fixedly mounted fasteners arranged in a pattern to mate with said plurality of blade mounting holes and said grommets, each of said fasteners having a base seat, a neck extending from said base seat having a neck diameter configured to be received within said central passage of said grommet and a head having a head diameter greater than said neck diameter, said neck also having an annular groove extending into said neck adjacent said head, whereby contact of the head against the grommet forces a portion of the grommet into the annular groove of the neck.

2. The fan blade mounting system of claim 1 wherein each head of said fastener includes a tool groove.

3. The fan blade counting system of claim 1 wherein said blade mounting portion has a generally planar peripheral edge and wherein said fastener seat has a top surface which is coplanar with said peripheral edge of said blade mounting portion.

4. A fan blade mounting system comprising a blade iron and a ceiling fan blade associated with said blade iron, said ceiling fan blade having a plurality of mounting holes and a resilient, annular grommet positioned within each of said mounting holes, said blade iron having a plurality of fixedly mounted fasteners arranged in a pattern to coincide with said plurality of blade mounting holes, each of said fasteners having a neck having a first portion with a first diameter and a second portion having a second diameter less than said first diameter, and a head extending from said second portion and having a third diameter greater than said first diameter and said second diameter, whereby contact of the head against the grommet forces a portion of the grommet into the second portion of the neck, wherein said blade iron includes a respective fastener seat associated with a corresponding one of said fasteners configured to engage a bottom surface of said grommet.

5. The fan blade mounting system of claim 4 wherein each head of said fasteners includes a tool groove.

6. The fan blade mounting system of claim 4 wherein said blade mounting portion has a generally planar peripheral edge and wherein said fastener seat has a top surface which is coplanar with said peripheral edge of said blade mounting portion.

7. A ceiling fan comprising, an electric motor, an annular array of blade irons mounted to said motor, and a ceiling fan blade associated with each blade iron of said annular array of blade irons, each said ceiling fan blade having a plurality of mounting holes and a resilient, annular grommet positioned within each of said mounting holes, each said grommet having a central passage therethrough, each said blade iron having a plurality of fixedly mounted fasteners, each fastener is configured to mate with one of said blade mounting holes, each said fastener having a neck portion configured to be received within said central passage of said grommet, said neck portion having a first portion with a first diameter and a second portion having a second diameter less than said first diameter, each said fastener also having a head portion extending from said neck portion having a third diameter greater than said first diameter of said neck portion and said second diameter of said neck portion, each said fastener also having a seat portion extending from said neck portion opposite said head portion, said seat portion having a fourth diameter greater than said first diameter of said neck portion, whereby contact of the head portion against the grommet forces a portion of the grommet into the second portion of the neck.

8. The ceiling fan of claim 7 wherein each head portion of said fasteners includes a tool groove.

9. The fan blade mounting system of claim 7 wherein said blade mounting portion has a generally planar peripheral edge and wherein said fastener seat has a top surface which is coplanar with said peripheral edge of said blade mounting portion.

* * * * *